United States Patent [19]

Lochridge

[11] Patent Number: 4,781,126

[45] Date of Patent: Nov. 1, 1988

[54] ADJUSTABLE DESK-TOP ASSEMBLY

[76] Inventor: Edwin P. Lochridge, 452 Ridgewood Rd., NE., Atlanta, Ga. 30307

[21] Appl. No.: 88,280

[22] Filed: Aug. 24, 1987

[51] Int. Cl.[4] ..... A47B 3/00

[52] U.S. Cl. ..... 108/6; 108/39; 108/90

[58] Field of Search ..... 108/6, 3, 7, 1, 38, 108/39, 2, 92, 93, 90, 91, 9, 43; 312/194, 196, 239, 326, 327; 248/1 A-1 J

[56] References Cited

U.S. PATENT DOCUMENTS

| | | | |
|---|---|---|---|
| 119,316 | 9/1871 | Carter et al. | 312/196 |
| 280,776 | 7/1883 | Altheide | 108/9 X |
| 818,910 | 3/1906 | Onons | 312/196 X |
| 1,568,356 | 1/1926 | Vumbaca | 312/194 X |
| 2,560,490 | 7/1951 | Smith | 312/326 X |
| 2,764,461 | 9/1950 | Montgomery | 312/327 X |
| 2,829,935 | 4/1958 | Colleau | 108/3 X |
| 3,048,461 | 8/1962 | Peterson | 312/196 |
| 3,506,323 | 4/1970 | Leprince | 312/194 X |
| 3,794,397 | 2/1974 | Flototto | 312/194 X |
| 3,872,800 | 3/1975 | Wallis et al. | 108/6 |
| 4,047,774 | 9/1977 | Hanning | 312/196 X |
| 4,190,303 | 2/1980 | Ellis | 312/196 X |
| 4,313,112 | 1/1982 | Foster | 108/92 X |
| 4,422,640 | 12/1983 | Tamarkin | 108/43 X |
| 4,428,631 | 1/1984 | Cope et al. | 108/92 X |
| 4,431,239 | 2/1984 | Vainikka | 312/196 X |
| 4,561,619 | 12/1985 | Robillard et al. | 248/1 B |
| 4,664,039 | 5/1987 | Schneider | 108/6 |
| 4,669,789 | 6/1987 | Pemberton | 312/194 X |

FOREIGN PATENT DOCUMENTS

| | | | |
|---|---|---|---|
| 1139955 | 11/1962 | Fed. Rep. of Germany | 108/92 |
| 7500772 | 1/1975 | Netherlands | 108/92 |

*Primary Examiner*—Kenneth J. Dorner
*Assistant Examiner*—José V. Chen
*Attorney, Agent, or Firm*—Hurt, Richardson, Garner, Todd, & Cadenhead

[57] ABSTRACT

An adjustable desk-top assembly is disclosed having upper, lower, and inner side panels, the upper and lower panels being spaced apart for forming a compartmentalized enclosure. The desk-top has an adjustable work surface capable of assuming a slope and a centralized cut-out portion therein for extending in a semi-circle around the user of the desk. The inner or door panels, are releasably secured and can be removed for accommodating any of a number of suitable components. The slope imparted to the work surface can be adjusted to an optimum level for the particular task and, by imparting greater slope and covering the components therein, a security measure is also provided.

9 Claims, 3 Drawing Sheets

ADJUSTABLE DESK-TOP ASSEMBLY

BACKGROUND OF THE INVENTION

Desks have evolved from simple table-like structures into some fairly complex designs. One example of such designs is found in U.S. Pat. No. 4,646,655 to Robolin for a Data Processing Work Station. A tubular framework is provided having multiple shelves for holding various components of a data processing system. Another example is found in U.S. Pat. No. 4,561,619 to Robillard et al. for a Movable CRT Pedestal. This design involves the use of a laterally movable support for the video display monitor. The support also includes telescoping arms for adjusting the distance of the monitor from the user.

Certain other desk designs involve the use of slanted and/or wrap-around work surfaces. Such designs can be found as early as 1903, as shown by U.S. Pat. No. 744,888 to Widman et al., for an Office Desk. This desk has a slanted work surface with a recessed central portion so as to wrap around the user. Another example is found in U.S. Pat. No. 1,293,952 to Shirley for a Desk, featuring a wrap-around design with storage compartments therein.

Many of these designs, however, are limited to a certain defined application. Thus, a desk designed specifically for a data processing work station may lack a writing surface. Others may not be able to accommodate a computer system or may make use of the keyboard or other components difficult or tiring.

SUMMARY OF THE INVENTION

It is therefore, one of the principal objects of the present invention to provide an adjustable desk-top assembly which can support a multiplicity of functions, such as a data processing station including storage capability, as well as a writing or drawing work surface, and which is convenient and comfortable for the user.

Another object of the present invention is to provide a desk-top assembly which can be retrofitted to a plurality of pedestals for converting existing desks, and which can be easily moved and installed on such pedestals.

A further object of the present invention is to provide a desk top assembly in which the work surface can be adjusted to suit the user and which is durable for providing a long service life.

These and other objects are attained by the present invention which relates to an adjustable desk-top assembly having a work surface capable of assuming a slope. The work surface is provided with a faceted, cut-out portion for allowing the user easy access to the rear portions of the desk-top assembly. Extending around the perimeter of the desk-top assembly are compartments for receiving and storing components of a computer system or the like. The work surface is easily adjusted to accommodate the user and the task, and can also be used to partially secure the components in the compartments.

Various additional objects and advantages will become apparent from the following detailed description with reference to the accompanying drawings.

DETAILED DESCRIPTION OF THE PREFERRED EMBODIMENT

Figure 1:
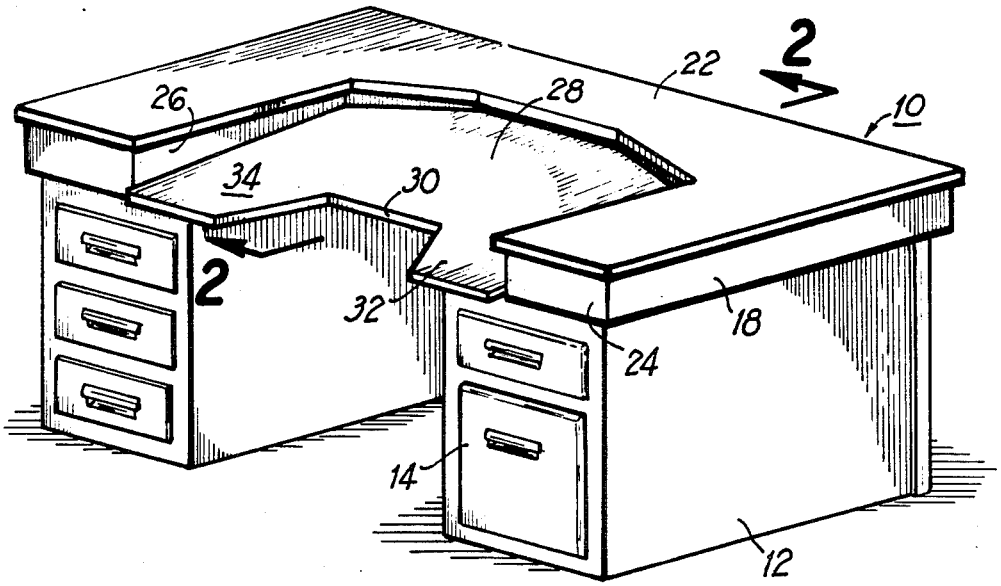
FIG. 1 is a perspective view of the present adjustable desk-top assembly, shown here in installed position on a conventional desk pedestal.

Referring now more specifically to the drawings and to FIG. 1 in particula, numeral 10 designates generally the adjustable desk top assembly of the present invention. The desk top assembly is shown here in installed position over a conventional desk pedestal 12 having the typical frame and drawers 14, however, it is to be understood that the present invention can be installed over any suitable pedestal, for example, that shown in FIG. 5. Similarly, the present desk top assembly is shown as being composed of wood. This however, is not meant to limit the present invention in any way as there are any number of suitable materials which could be employed to construct the present invention, for example, plastic or metal.

The present desk top assembly includes a generally rectangular frame defined by a base member or lower panel member 16, generally vertical side and back panel members 18 and 20 respectively, which panels extend perpendicularly from the base member 16, and a generally planar upper panel member 22, which is disposed generally parallel to the lower panel 16. In addition, front panels 24 are secured to each of the side panels 18 and a plurality of door means or inside panels 26 are provided adjacent the front panels 24 and between the upper and lower panels to effectively form an enclosed box like structure having the central portion thereof cutout, as shown in FIG. 1. The cutout portion is generally semicircular, with a preferred embodiment being shown in which the cutout portion is faceted for reasons which will be more fully explained hereinafter.

Figure 2:
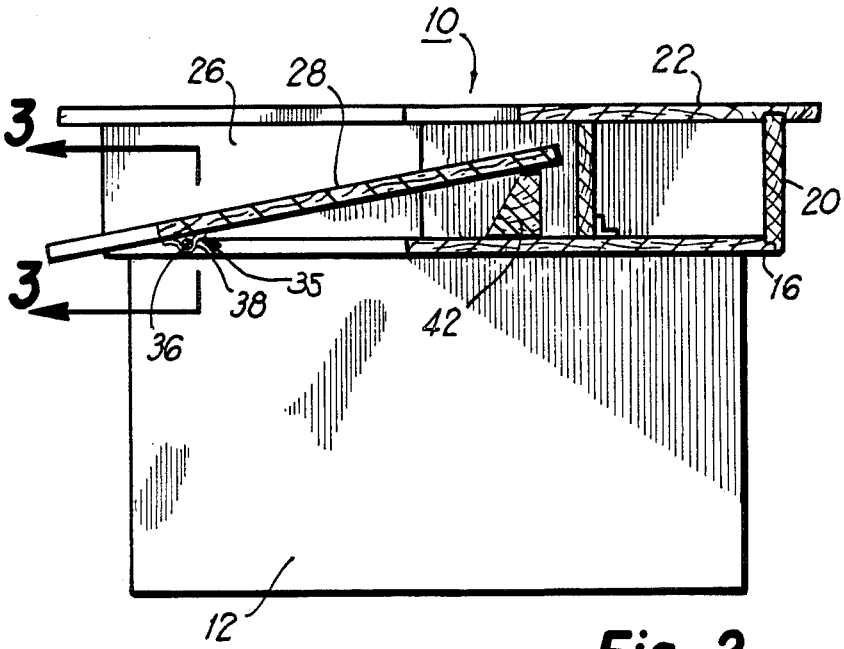
FIG. 2 is a side elevational view, shown partially in cross-section, showing one embodiment of the adjustment mechanism for the work surface of the present invention the section being taken on line 2—2 of FIG. 1.
Figure 3:
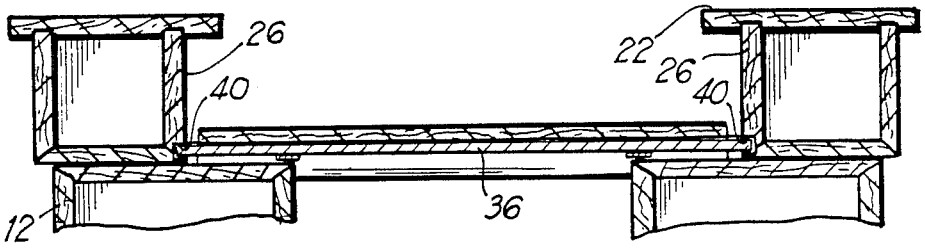
FIG. 3 is a partial cross-sectional view of the present desk-top assembly, the view being taken on line 3—3 of FIG. 2.

The work surface 28 of the present desk top assembly is disposed within the cutout portion of the upper or top panel 22 and has a faceted inner edge corresponding to the facets formed in the top panel 22. The outwardly facing edge or edge which faces the user has a cutout portion indicated by numeral 30, allowing the user to be positioned close to the work surface, thus, the front side of the desk, which is the side opposite the rear panel 20, is considered the user's station and is, as shown in FIG. 1, in the region defined by and adjacent to edge 30 which defines the generally semicircular cut-out portion of work surface 28. This has several advantages. As shown in FIG. 1, the work surface 28 includes right and left extension 32 and 34 respectively on either side of the cutout portion defined by edge 30. This provides an arm rest for writing for either a right or left handed user. In addition, the cutout portion defined by edge 30 allows the user to easily reach any components or other materials which are stored in the compartments behind panel 26. Referring to FIGS. 2 and 3, the range of movement for the work surface is detailed. A securing means 35 including a bar 36 fastened secured near the front edge of the work surface 28 by brackets 38, thereby providing a pivot point. The ends of bar 36 are effectively secured within the desk top assembly, being secured within slots or apertures 4 formed near the bottom portion of side panels 26 as shown in FIG. 3.

Referring to FIG. 2, one embodiment of a device for adjusting the back edge of the work surface 28 is illustrated. A spacer block 42 is disposed beneath the back edge of the work surface 28 for adjusting the elevation of the work surface relative to the base member 16. This slope imparted to the work surface may vary from approximately zero to approximately 45 degrees by adjusting the spacer forwardly or rearwardly beneath the back edge of the work surface 28. With this embodiment, as the spacer is moved to the extreme forward portion, the back edge of the work surface can ride down the slope of the triangular spacer block for making incremental adjustments in the slope of the work surface, the securement of the front edge by bar 36 preventing the work surface from sliding. The block may also be removed completely for providing the work surface with essentially no slope.

Figure 4:
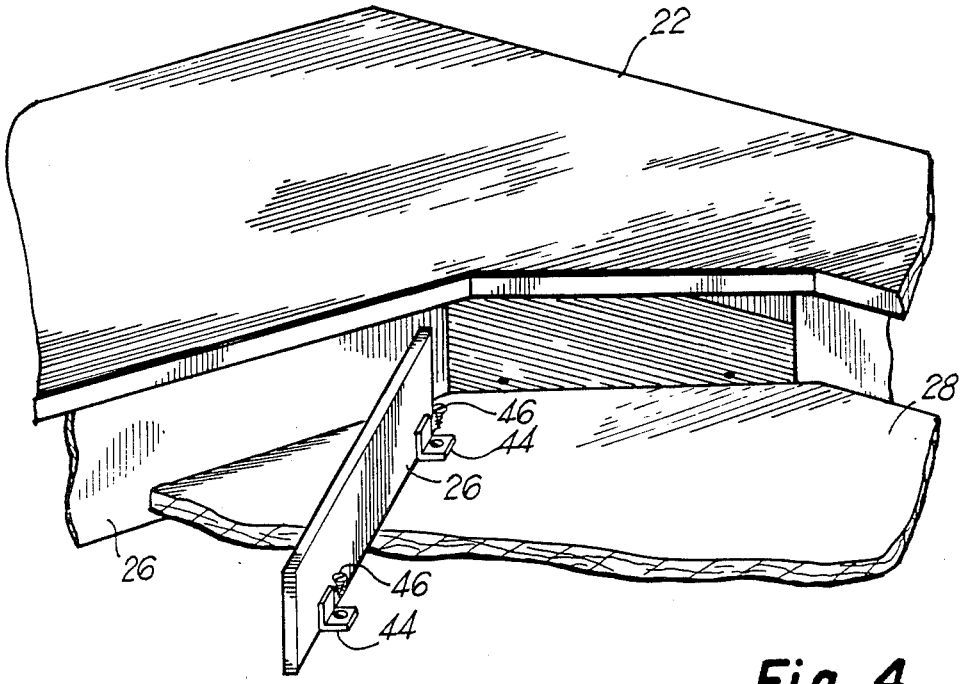
FIG. 4 is a partial perspective view of one of the internal compartments of the present invention, shown here with the cover removed.

As noted previously, the present desk top assembly is constructed so as to define a plurality of compartments which may be used for a variety of purposes, such as the storage of components for a data processing system. The compartments may or may not be provided with internal walls, however, all are defined at the front of the compartment by the inside panels 26. Suitable fastening means, such as brackets 44 and screws 46 are used internally to secure the panels 26 to the base member 16. Once secured, access to the screws and brackets is obtained by lifting the top panel 22 off of the present assembly, the symmetrical configuration making such lifting relatively easy, or by sliding the panel forwardly or back to gain access. Referring still to FIG. 4, with any of the panels 26 removed, the slope of work surface 28 can be adjusted so as to permit access to the component stored behind that particular panel 26 or its corresponding slot. For example, disposed in the open compartment in FIG. 4 could be a disk drive unit which could be conveniently stored therein, such units generally requiring access only to the disk insertion slots after they have been connected to the system. In similar fashion, any wiring or other connections can be conveniently disposed within the compartments, thus keeping the wires protected and out of sight.

The adjustability of the work surface 28 also serves a security function, in that increasing the slope of the work surface as shown in FIG. 1 serves to cut off from view the components disposed in the various compartments, thereby reducing the possibility that the components will be either accidently activated or stolen. When the components are again needed by the operator, the slope of the work surface 28 need only be reduced so as to allow access to the component as shown in FIG. 4.

Figure 5:
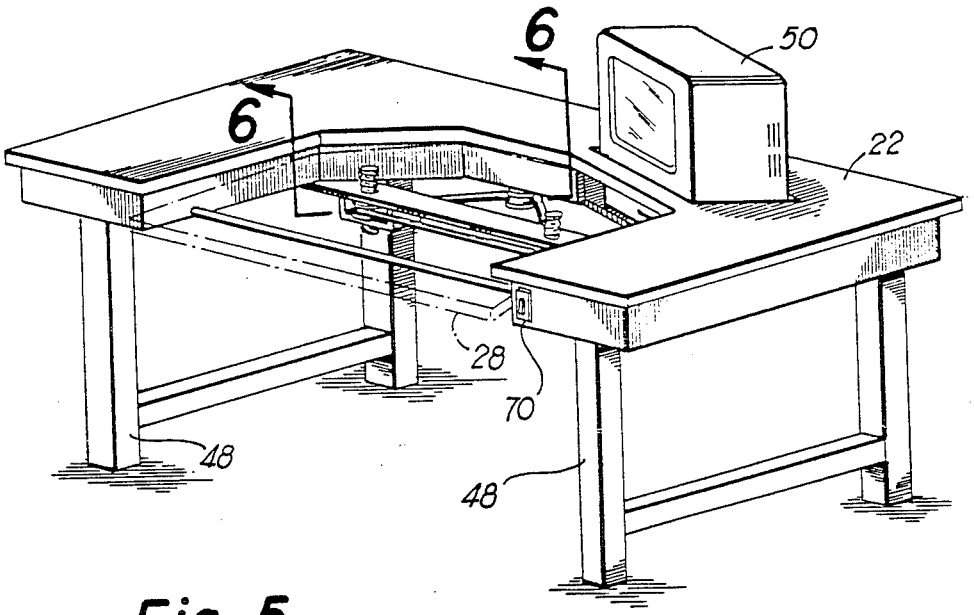
FIG. 5 is a perspective view of an alternate embodiment of the present desk-top assembly, shown here with the work surface removed to illustrate the adjustment mechanism.
Figure 6:
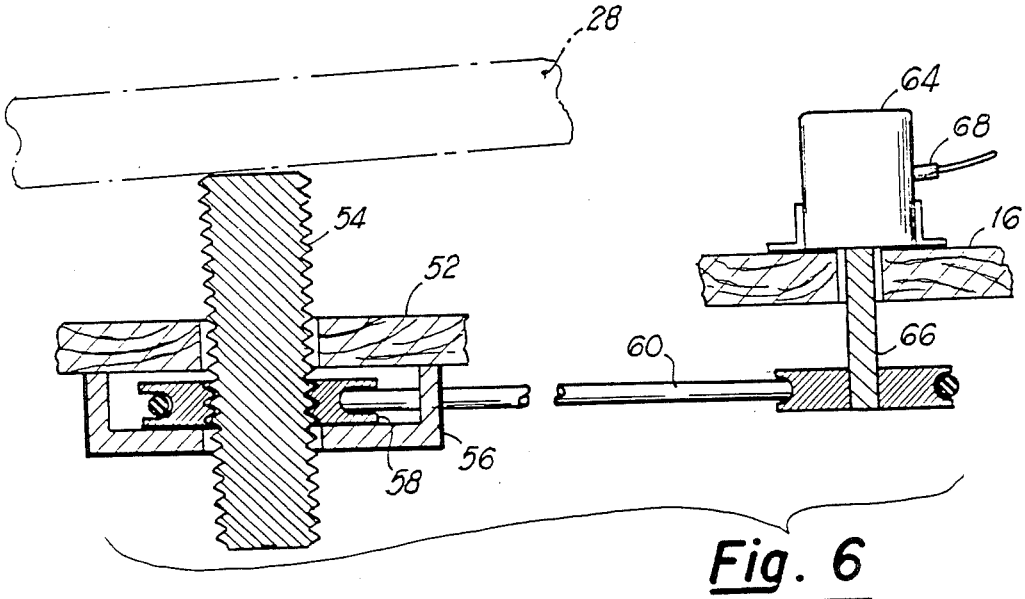
FIG. 6 is a partial cross-sectional view showing in detail the alternate embodiment of the adjustment mechanism, the view being taken on line 6—6 of FIG. 6.

FIGS. 5 and 6 illustrate an alternate embodiment of an adjustment means for moving the work surface 28. In addition, illustrated is the applicability of the present desk top assembly to a pedestal other than the conventional desk pedestal shown in FIG. 1. This pedestal 48 is comprised mainly of a set of legs only, illustrating that the present invention is an essentially self contained unit which can be mounted on a plurality of pedestal means. Another modification is shown in FIG. 5, where a portion of the top panel 22 has been removed and a video display monitor 50 is inserted therein. As can be seen from FIG. 5, the present desk top assembly has sufficient depth to receive and secure the monitor, while the inside panel 26 in front of the installed monitor may be removed for access to any monitor controls which are disposed below the level of the top surface 22.

The work surface 28 has been shown in phantom lines in FIGS. 5 and 6 so as to clearly show the adjustment means used for this embodiment. Extending between the right and left sides of the base member 16 and secured thereto is a transverse support bar 52. Extending upwardly through the bar is at least one and preferably two jack screws 54 which are disposed for axial movement therein. Secured to the underside of bar 52 is a bracket means 56 for securing a pulley 58 or similar means therein. Each of the jack screws is threadedly engaged by a pulley 58 the pulleys being connected through a cable 60 or other suitable means. The cable extends around both pulleys 58 and around a third pulley 62 which is operatively connected to a motor 64 or similar means for moving the pulley and cable arrangement. The motor is mounted inside one of the compartments on base member 16 and has a shaft 66 extending downwardly therefrom to fixedly engage and turn pulleys 62. This in turn causes rotation of pulleys 58 which operate to move the jack screws vertically due to the threaded engagement with the pulleys. This vertical movement of the jack screw serves to adjust the slope of the work surface 28 to the level desired by the user. The motor 64 is connected through power cord 68 to a suitable source of power and the motor may have a conveniently mounted switch 70 or similar means for activating the motor.

The use and operation of the present adjustable desk top assembly have been described hereinabove. The present assembly may be installed over conventional desk pedestals, drafting table supports, or a number of other suitable support means. The adjustable work surface is capable of assuming a slope and can be adjusted for comfort in writing, typing, drawing or any of a number of tasks, including simply reading. A number of suitable materials may be used for constructing the present desk top assembly ranging from solid wood or veneered products to lightweight metals or plastic. Similarly, the present invention can be scaled to any desired size making it suitable for home, school or office environments.

While an embodiment and a modification of an adjustable desk top assembly have been shown and described in detail herein, various other changes and modifications may be made without departing from the scope of the present invention.

I claim:

1. An adjustable desk-top assembly for installation over a pedestal, the assembly having a front side and a rear side with a user's station being disposed adjacent said front side and generally centrally located along said front side, said assembly comprising spaced upper and lower panel members disposed generally parallel to one another and having side panel members disposed therebetween and secured respectively to said upper and lower panel members for defining storage compartments, said upper and lower panel members having front and rear sides with a generally semicircular cutout portion in said front side and extending inwardly from the user's station of said assembly, a work surface disposed in said cut-out portion having front and rear edges with securing means connected near said front edge, said securing means being disposed within said lower panel member for maintaining said work surface in a defined area relative to said upper and lower panels, adjustment means disposed near said rear edge of said work surface for raising and lowering said rear edge for imparting a slope to said work surface, and door means, releasably secured between said upper and lower panels and along said rear edge of said work surface for closing the compartments formed therein.

2. An adjustable desk-top assembly as defined in claim 1 in which said upper and lower panels have a faceted inner edge for defining said cut-out portion and said work surface has a faceted rear edge complementary to said faceted edges of said upper and lower panels.

3. An adjustable desk-top assembly as defined claim 1 in which said adjustment means includes a bar means fixedly secured to said work surface and to said lower panel for providing a pivot point, and means disposed beneath said work surface near said rear edge thereof and resting on said lower panel for raising and lowering said rear edge of said work surface relative to said bar means to adjust the slope thereof.

4. An adjustable desk-top assembly as defined claim 1 in which said adjustment means disposed beneath said work surface includes a bar means fixedly secured near said front edge of said work surface and to said lower panel for providing a pivot point, and vertically extending screw means having a body portion engaging said rear edge of said work surface, and means for raising and lowering said screw means.

5. An adjustable desk-top assembly as defined in claim 1 in which said upper panel includes an aperture therein for receiving a display terminal.

6. An adjustable desk-top assembly for installation over a desk pedestal or like structure in place of the conventional desk-top, said assembly comprising upper and lower panel members having a front side and a rear side with a user's station being located generally centrally along said front side, said panel members disposed generally parallel to one another and being spaced apart, said panel members also having a centralized, generally semicircular, first cut-out portion extending inwardly into said panel members from said front side thereof, outer panel members secured between upper and lower panel members around the outer perimeter of said upper and lower panel members and inner panel members releasably secured between said upper and lower panel members around said cut-out portion in opposed relationship to said outer panel members for forming an enclosure therebetween, a work surface disposed in said cut-out portion having a rear edge corresponding to the edges of said cut-out portion and a front edge having a centralized, generally semi-circular second cut-out portion for receiving and accommodating the user of said desk-top assembly, and adjustment means disposed beneath said work surface for raising and lowering said work surface to impart a slope thereto.

7. An adjustable desk-top assembly as defined in claim 6 in which said adjustment means includes a bar means fixedly secured to said work surface and to said lower panel for providing a pivot point, and means disposed beneath said work surface near said rear edge thereof and resting on said lower panel for raising and lowering said rear edge of said work surface to adjust the slope.

8. An adjustable desk-top assembly as defined in claim 6 in which said adjustment means disposed beneath said work surface includes a bar means fixedly secured near said front edge of said work surface and to said lower panel for providing a pivot point, and vertically extending screw means engaged with said rear edge of said work surface, and means for raising and lowering said screw means.

9. An adjustable desk-top assembly for installation over a pedestal, said assembly comprising spaced upper and lower panel members having a front side and a rear side with a user's station being located adjacent said front side, said panel members also being disposed generally paralell to one another and having side panel members disposed therebetween and secured respectively to said upper and lower panel members for defining storage compartments, said upper and lower panel members having a generally semicircular cut-out portion extending inwardly from the user's station of said assembly, a work surface disposed in said cut-out portion having front and rear edges with securing means connected near said front edge, said securing means being disposed within said lower panel member for maintaining said work surface in a defined area relative to said upper and lower panel, and adjustment means disposed near said rear edge of said work surface for raising and lowering said rear edge for imparting a slope to said work surface.

* * * * *